United States Patent [19]

Kondoh et al.

[11] Patent Number: 5,072,766

[45] Date of Patent: Dec. 17, 1991

[54] PANEL SHUTTER ASSEMBLY

[75] Inventors: Kohichi Kondoh; Fumio Yagi, both of Tokyo, Japan

[73] Assignee: Bunka Shutter Co., Ltd., Tokyo, Japan

[21] Appl. No.: 637,037

[22] Filed: Jan. 3, 1991

[51] Int. Cl.[5] ..... E06B 3/92

[52] U.S. Cl. ..... 160/36; 160/32

[58] Field of Search ..... 160/33, 35, 36, 37, 160/32, 175, 201, 207, 218, 188, 193

[56] References Cited

U.S. PATENT DOCUMENTS

| | | | |
|---|---|---|---|
| 4,595,043 | 6/1986 | Nozawa et al. | 160/32 X |
| 4,662,420 | 5/1987 | Hirao | 160/32 |
| 4,807,685 | 2/1989 | Losch | 160/36 |
| 4,838,331 | 6/1989 | Kasai | 160/36 |

*Primary Examiner*—Carl D. Friedman
*Assistant Examiner*—Derek J. Berger
*Attorney, Agent, or Firm*—Rothwell, Figg, Ernst & Kurz

[57] ABSTRACT

In a panel shutter assembly including a plurality of shutter panels which are movable up and down along a pair of transversely spaced upstanding guide rails, a pair of chains to which the panels are fastened one after another, a set of sprockets engaging the chains for moving the chains in either direction to move the panels to open and close a shutter opening, and a pair of panel supporting rails from which the panels are suspended in a panel storage space when the shutter opening is opened, the sprockets consist of a pair of first sprockets for moving the panels up and down and a pair of sound sprockets spaced horizontally apart from the first sprockets and provided between the first sprockets and the panel storage space for moving the panels horizontally, and the panel supporting rails extend horizontally. The horizontal supporting rails enable a reduction in height of a box defining the panel storage space. A guide plate or plates can be provided in the box for holding each chain to ensure its horizontal movement between one of the first sprockets and one of the second sprockets and thereby the smooth movement of the panels in the box. Each of the second sprockets can be formed between the roots of every two adjoining teeth thereof with a semicircular recess in which the link pins of the corresponding chain are engageable, so that the chain leaving the second sprocket for the panel storage space may form a U-shaped sag to ensure that all the panels to properly retracted into the panel storage space.

5 Claims, 12 Drawing Sheets

PANEL SHUTTER ASSEMBLY

BACKGROUND OF THE INVENTION

1. Field of the Invention

This invention relates to a panel shutter assembly for the entrance or exit of a building, a window, etc.

2. Description of the Prior Art

There is known a panel shutter assembly comprising a plurality of panels which are vertically movable to open and close automatically an opening, such as the entrance or exit of a building, or a window. The assembly has drawn attention particularly because of its excellent fireproofness.

The known panel shutter assembly is of the construction as shown by way of example in FIG. 15. It includes a pair of vertically extending and horizontally spaced apart guide rails 1 disposed along two vertical edges, respectively, of a shutter opening, i.e. the opening which is opened or closed by the shutter assembly to open or close the entrance or exit of a building, a window, etc. A panel storage box 2 is provided above the guide rails 1. The box 2 has an opening and is provided above its opening with a pair of horizontally spaced apart panel driving sprockets 3. The sprockets 3 are rotatable in either of two opposite directions by panel driving means M of which the output is transmitted to the sprockets 3 through speed reducers, etc. A pair of horizontally spaced apart chains 4 mesh with the sprockets 3, respectively, and are vertically movable along the guide rails 1, respectively.

A plurality of vertically adjoining shutter panels 5 are flexurally connected to one another by the chains 4 between the guide rails 1. Each panel 5 carries a pair of guide rollers 6 each at the upper end of one of its vertical edges. The guide rollers 6 are vertically movably engaged with the guide rails 1, respectively, and are capable of riding on a pair of panel supporting rails 7, respectively, which are situated in the upper portion of the box 2. The supporting rails 7 are downwardly inclined to some extent as they extend away from the sprockets 3.

Description will now be made of the operation of the shutter assembly as hereinabove described. The assembly is in its closed position when all the panels 5 lie between the guide rails 1. If the panel driving means M is started to withdraw the panels 5 into the box 2, the sprockets 3 are rotated in the direction of an arrow and cause the chains 4 to move up along the guide rails 1 and thereby withdraw the panels 5 into the box 2 one after another. If the guide rollers 6 carried by the uppermost panel 5 move past the sprockets 3 and ride on the supporting rails 7, the weight of the panel 5 causes the guide rollers 6 to roll down the inclined supporting rails 7 to bring the panel 5 to its retracted position in which it is suspended from the supporting rails 7. As the panels 5 are all fastened to the chains 4, they are withdrawn into the box 2 one after another and are folded when they are moved past the sprockets 3 and suspended from the supporting rails 7. The panels 5 which have been folded and suspended stay in a parallel and horizontally adjoining relation to one another.

It is possible to bring the shutter assembly to its closed position covering the shutter opening again if the panel driving means M is actuated for rotation in the opposite direction. The sprockets 3 are driven in the direction opposite that shown by the arrow and the chains 4 are, therefore, moved in the opposite direction to transfer the panels 5 from the supporting rails 7 to the guide rails 1.

The known panel shutter assembly as hereinabove described has, however, a drawback which is due to the inclination of the supporting rails 7. It is not sufficient for the box 2 to have a height h which is determined by the height of the individual panels 5 as folded, but it is necessary to add to it an increment $\Delta h$ which can cover the difference in vertical position between the lowest and highest panels 5. The increase in height of the box 2 makes it necessary to lower correspondingly the ceiling of e.g. a store in the event that the box is mounted above the ceiling. It necessarily restricts the height of the opening which can be covered by the shutter panels. It may also exert an adverse effect on the outward appearance of the shutter assembly as a whole.

The increment h in height of the box 2 can be eliminated if the supporting rails 7 are horizontally disposed, as shown in FIG. 16. The horizontal arrangement of the supporting rails 7 is, however, not sufficient for ensuring the smooth withdrawal of the panels 5 into the box 2. Any leading panel 5 stops moving immediately after passing around the sprockets 3 and the panel 5 following it strikes against the leading panel 5 when moving past the sprockets 3.

The assembly shown in FIG. 16 includes an outer or upper guide plate 13 and an inner or lower guide plate 14 which are provided for holding the chains 4 therebetween to guide them for movement in the direction in which the panels 5 are to be withdrawn. The chains 4 are expected to sag as shown at 4*f* upon leaving the space between the outer and inner guide plates 13 and 14. If no such sagging takes place smoothly, however, the chains 4 are undesirably folded in a zigzag pattern as shown in FIG. 19. The chains 4 which have been folded without forming any sag 4*f* make an obstacle between every two adjoining panels and are very likely to allow only two or three panels 5 to be properly retracted.

SUMMARY OF THE INVENTION

It is a principal object of this invention to provide a panel shutter assembly including panels which are comparable in dimensions to those of any standard panel shutter assembly known in the art, and yet a panel storage box which is smaller in height than the known box having inclined panel supporting rails.

It is another object of this invention to provide a panel shutter assembly which can always ensure the smooth movement of panels in a panel storage box.

It is still another object of this invention to provide a panel shutter assembly which enables the proper retraction of all panels when the shutter is fully opened.

These and other objects, and novel features of this invention will become more apparent from the following detailed description and the accompanying drawings. It is, however, to be understood that the drawings are only illustrative, and are not intended for limiting the scope of this invention.

The principal object of this invention as hereinabove stated is attained by a panel shutter assembly which comprises a plurality of shutter panels, a box defining a panel storage space, a pair of first sprockets provided in the box for moving the panels vertically, a pair of second sprockets provided in the box for moving the panels horizontally, the second sprockets being horizontally spaced apart from the first sprockets and the panel storage space being defined on the opposite side of the second sprockets from the first sprockets, a pair of chains connecting the panels to one another and each meshing with one of the first sprockets and one of the second sprockets, and a pair of horizontally disposed panel supporting rails from which the panels are suspended in parallel to one another in the panel storage space when they are out of service.

The second object of this invention is attained by a panel shutter assembly substantially as hereinabove set forth, but further including a pair of guide plates provided one above the other for holding each chain therebetween to guide its horizontal movement between one of the first sprockets and one of the second sprockets.

The third object of this invention is attained by a panel shutter assembly substantially as hereinabove set forth, but further characterized in that each of the second sprockets is formed between the roots of every two adjoining teeth thereof with a semicircular recess in which the link pins of the chain are engageable one after another.

The panels which have been moved vertically into the box by the first sprockets are moved horizontally by a certain distance toward the panel storage space by the second sprockets, before they are suspended from the horizontal supporting rails.

The horizontal arrangement of the supporting rails enables the panel storage box to be smaller in height than the box of any known similar panel shutter assembly having inclined supporting rails. The shutter assembly of this invention can, therefore, be mounted within the space above the ceiling of a store or like place, or even below a low ceiling without imposing any appreciable restriction on the height of its entrance or exit opening. The reduced height of the box also improves the outward appearance of the whole assembly.

The panels are caused to move horizontally from the first sprockets to the second sprockets, or vice versa when they are delivered out of the box. Referring, for example, to the case in which the panels are withdrawn into the box, a particular panel which has been passed around the first sprockets is moved horizontally by the certain distance to the second sprockets before it is stopped. Even if another panel may swing when passing around the first sprockets, therefore, it does not strike against the panel staying at a standstill. This ensures the smooth withdrawal of the panels into the box, as well as the smooth delivery thereof from the box.

The guide plates hold the chains in their horizontal positions between the first and second sprockets and thereby ensure that the panels to be withdrawn be horizontally moved with the chains from the first to the second sprockets before they are suspended from the horizontal supporting rails. Each panel stops moving when it has been moved past the second sprockets and suspended from the supporting rails, and another panel following it pushes it into the panel storage space along the supporting rails. Even if any panel may swing when moving past the first sprockets, it does not strike against the preceding panel staying at a standstill after the second sprockets. Therefore, all the panels can be smoothly withdrawn into the box. The smooth movement of the panels can likewise be achieved when they are delivered from the box.

The engagement of the link pins of the chains with the recesses at the roots of the teeth on the second sprockets ensures the proper sagging of the chains after the second sprockets when the panels are withdrawn along the supporting rails, since the chains are urged downwardly when leaving the second sprockets. The chains form a U-shaped sag between every two adjoining panels suspended from the supporting rails and thereby allow all the panels to be properly withdrawn into the panel storage space.

DETAILED DESCRIPTION OF THE PREFERRED EMBODIMENTS

A few preferred embodiments of this invention will now be described in detail with reference to the accompanying drawings.

Reference is first made to FIGS. 1 to 8 for the description of a panel shutter assembly embodying this invention. Like numerals are used to denote like parts throughout FIGS. 1 to 8 and FIGS. 15 to 19 and no repeated description will be made of those parts which have already been described.

Figure 1:
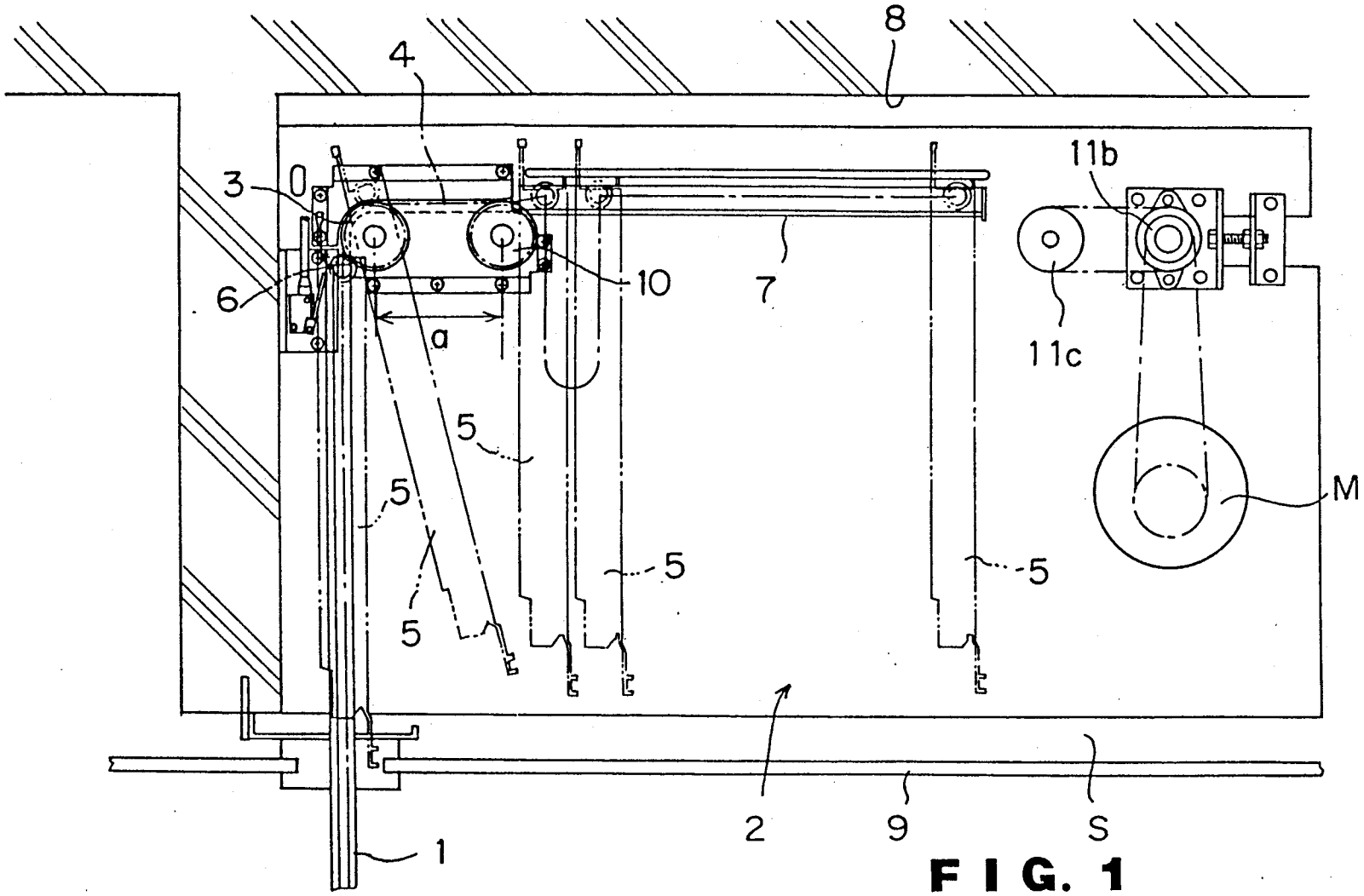
FIG. 1 is a vertical sectional view of the panel storage box in a panel shutter assembly embodying this invention.
Figure 2:
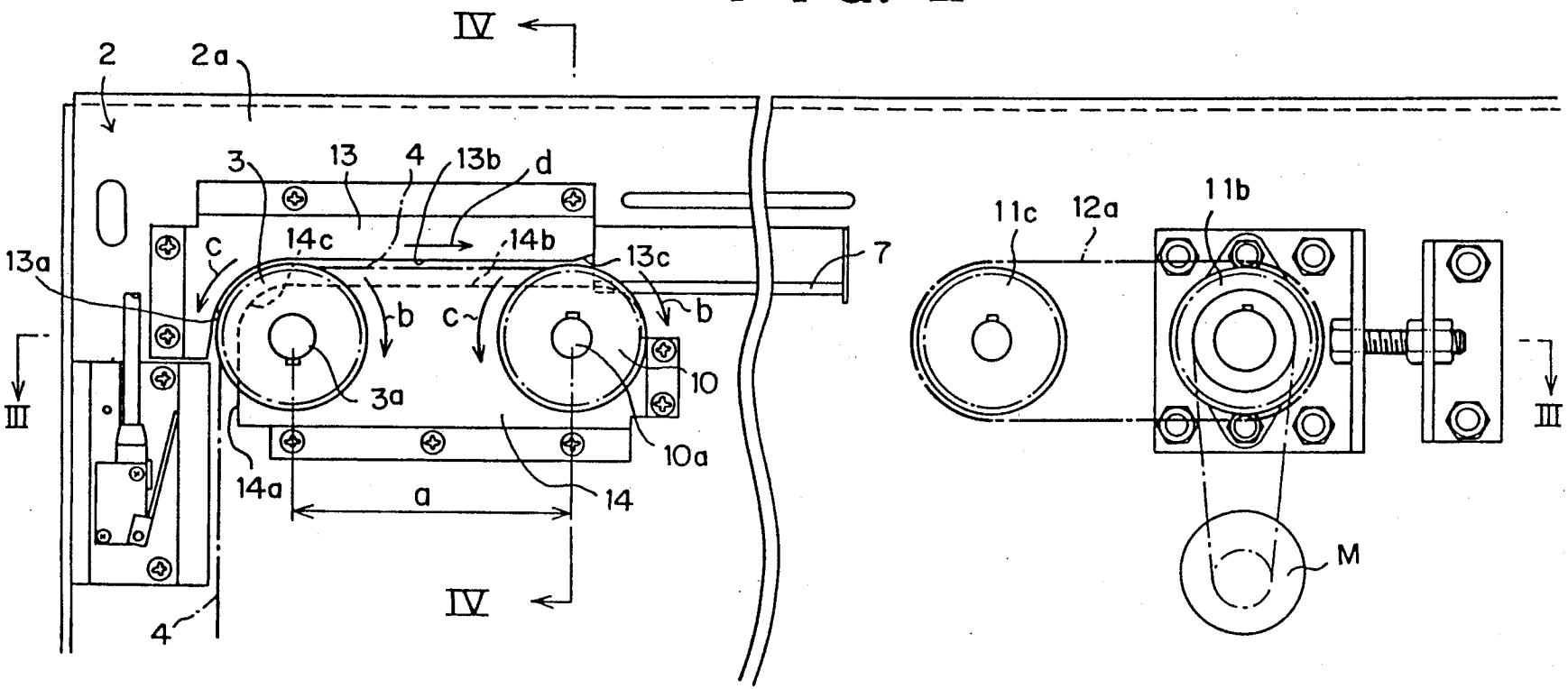
FIG. 2 is an enlarged view of a part of FIG. 1.
Figure 3:
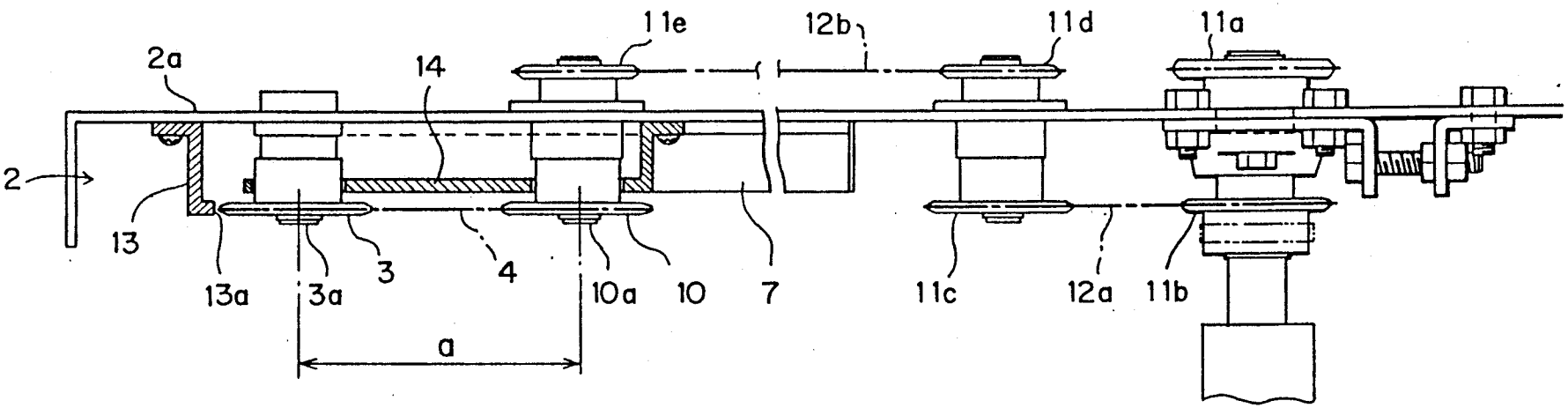
FIG. 3 is a view taken along the line III—III of FIG. 2.
Figure 4:
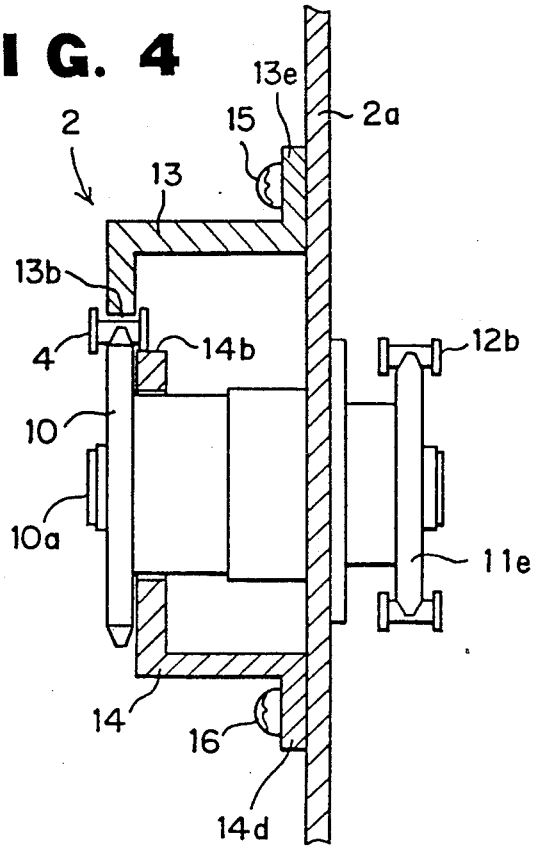
FIG. 4 is a view taken along the line IV—IV of FIG. 2.

The panel shutter assembly includes a panel storage box 2 mounted in a ceiling space S defined between the top wall 8, as of concrete, of e.g. a store and a material forming its ceiling 9, as shown in FIG. 1. The box 2 is used for storing a plurality of shutter panels 5 when they are not used to form a shutter covering the entrance or exit opening of the store. The box 2 has a bottom opening located immediately above the entrance or exit opening of the store. The box 2 contains a pair of first sprockets 3 located above its bottom opening and near its top wall, and a pair of second sprockets 10 which are horizontally and rearwardly spaced apart by a certain distance a from the first sprockets 3. The first sprockets 3 are used for moving the panels 5 vertically, and the second sprockets 10 for moving them horizontally. Each sprocket 3 or 10 is rotatably supported on the sidewall 2*a* of the box 2 by a sprocket shaft 3*a* or 10*a*, as shown in FIGS. 2 to 4. The second sprockets 10 are rotatable in either of two opposite directions as indicated by arrows b and c when rotation is transmitted to them from a panel driving mechanism M through a set of intermediate sprockets 11*a* to 11*e* mounted rotatably on the sidewall 2*a* and chains 12*a* and 12*b* associated therewith.

Figure 17:
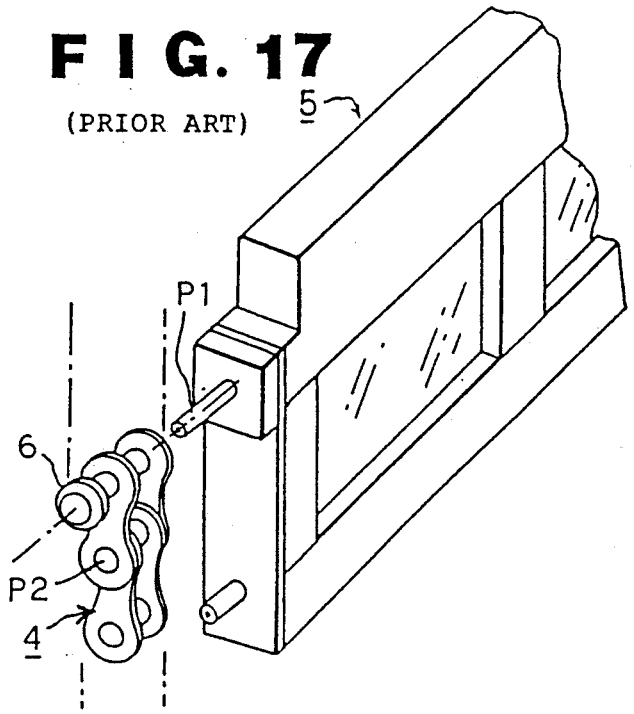
FIG. 17 (PRIOR ART)
FIG. 17 is a fragmentary perspective view of a panel.
Figure 18:
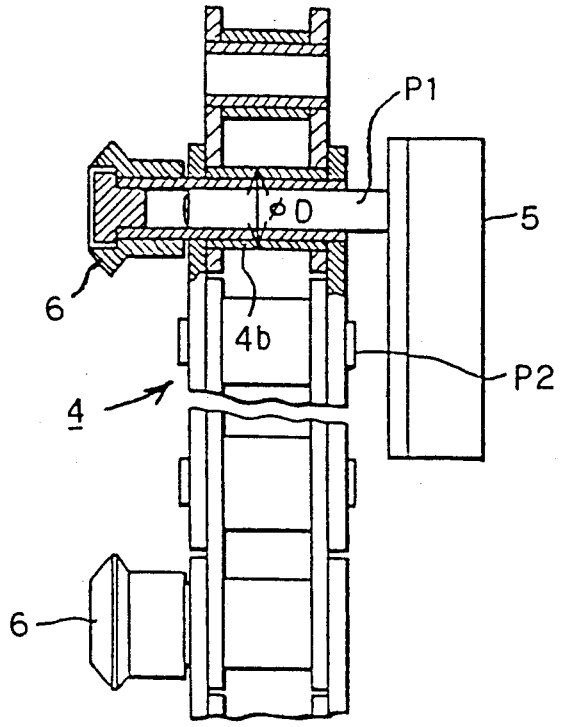
FIG. 18 (PRIOR ART)
FIG. 18 is a fragmentary front elevational view, partly in section, of a chain connecting panels.
Figure 19:
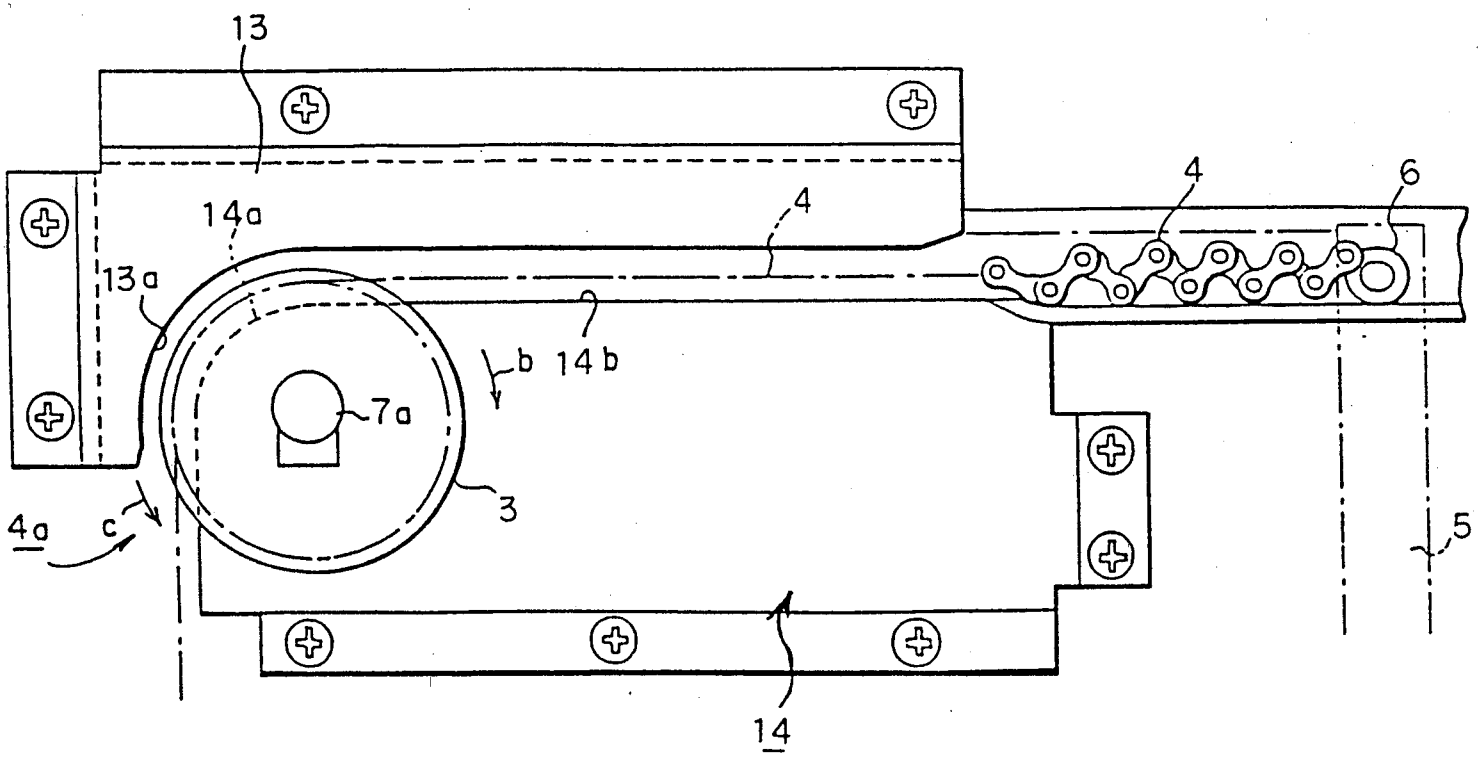
FIG. 19 (PRIOR ART)
FIG. 19 is an enlarged view of the chain guide plates shown in FIG. 16.

The panels 5 are connected to a pair of chains 4. Each chain 4 has a portion extending in a stretched form between the tops of one of the first sprockets 3 and one of the second sprockets 10. Attention is drawn to FIGS. 17 and 18 showing the way in which each panel 5 is fastened to the chains 4. Each panel 5 has a pair of long pins P projecting outwardly from the opposite vertical edges, respectively, thereof adjacent to the top thereof, though only one of them is shown in FIGS. 17 and 18. Each chain 4 has a plurality of hollow cylindrical pins 4*a* and each pin P of each panel 5 is inserted in one of the hollow pins 4*a* on one of the chains 4, as shown in FIG. 18, whereby all the panels 5 are rotatably fastened to the chains 4 one after another. Each hollow pin 4*a* is rotatably fitted in a bush 4*b* and has an end projecting from it on the opposite side of the bush 4*b* on the projecting end of the pin 4*a*. The construction of the chains 4 and the way of fastening the panels 5 to the chains 4 as hereinabove described are known in the art.

If the panel driving mechanism M is actuated for rotating the second sprockets 10 in either direction as indicated by the arrow b or c, the rotation thereof is transmitted by the chains 4 to cause the rotation of the first sprockets 3 in the same direction b or c.

The box 2 also contains a pair of panel supporting rails 7 lying horizontally in a panel storage space defined on the opposite side of the second sprockets 10 from the first sprockets 3. The rails 7 are mounted on the sidewall 2*a* of the box 2.

An upper guide plate 13 is provided along and above each chain 4 between the corresponding first and second sprockets 3 and 10, and a lower guide plate 14 along and below the chain 4. The upper guide plate 13 has an arcuate guide surface 13*a* and a horizontal guide surface 13*b* contiguous to it which form a substantially L-shaped contour and lie in parallel to the outer contour of the chain 4 extending in a substantially L-shaped form about the first sprocket 3 and between the first and second sprockets 3 and 10. The horizontal guide surface 13*b* terminates in a slanting surface 13*c* directed rearwardly and upwardly from substantially above the crest of the second sprocket 10.

The lower guide plate 14 has a vertical guide surface 14*a*, a horizontal guide surface 14*b* and an arcuate guide surface 14*c* defined therebetween which form a substantially L-shaped contour and lie in parallel to the inner contour of the chaine 4, but in a somewhat laterally deviating relation from the centerline of the chain 4, while the guide surfaces of the upper guide plate 13 lie exactly in vertical alignment with it, as is obvious from FIG. 4.

Figure 5:
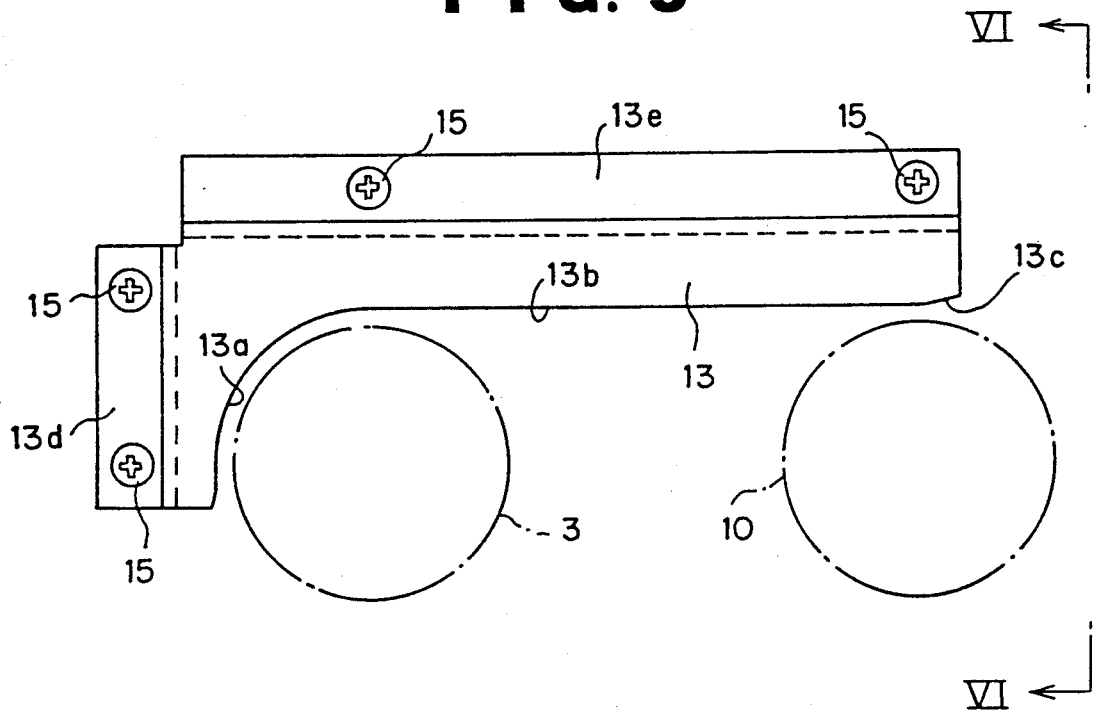
FIG. 5 is a side elevational view of an upper guide plate.
Figure 6:
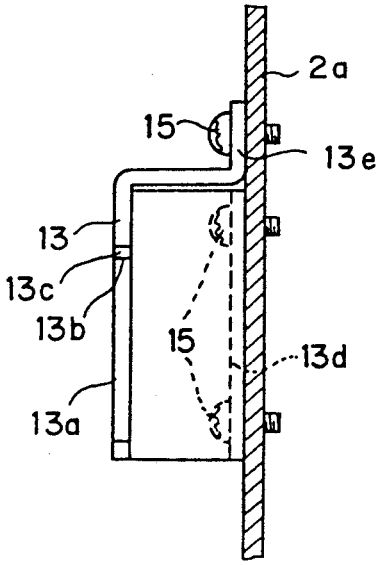
FIG. 6 is a view taken along the line VI—VI of FIG. 5.
Figure 7:
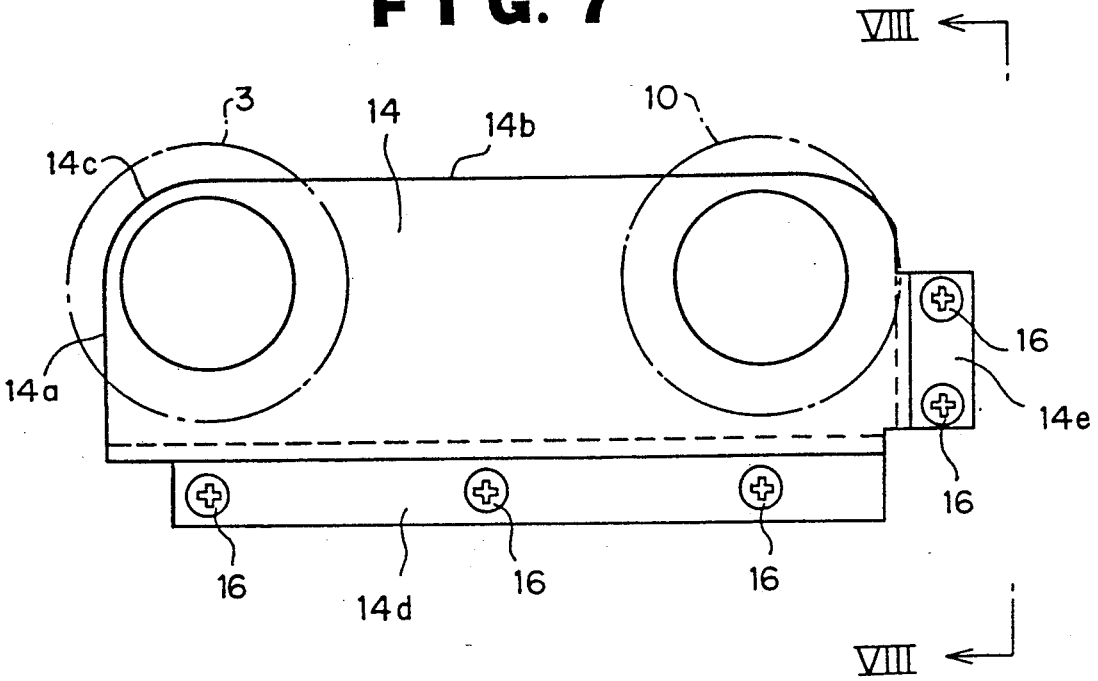
FIG. 7 is a side elevational view of a lower guide plate.
Figure 8:
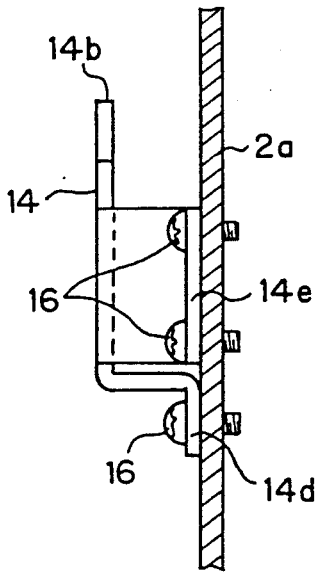
FIG. 8 is a view taken along the line VIII—VIII of FIG. 7.

The upper guide plate 13 is mounted on the sidewall 2*a* of the box 2 by two lugs 13*d* and 13*e* formed by pressing along the front and upper edges, respectively, of the guide plate 13 and secured by screws 15 to the sidewall 2*a*, as shown in FIGS. 5 and 6. The lower guide plate 14 is mounted on the sidewall 2*a* of the box 2 by two lugs 14*d* and 14*e* formed by pressing along the lower and rear edges, respectively, of the guide plate 14 and secured by screws 16 to the sidewall 2*a*, as shown in FIGS. 7 and 8.

Description will now be made of the operation of the assembly as hereinabove described, on the assumption that the shutter is in service, i.e. the panels 5 stay one above another between a pair of transversely spaced apart upstanding guide rails 1. If the panel driving mechanism M is actuated to withdraw the panels 5 into the panel storage space in the box 2, the first and second sprockets 3 and 10 are all rotated in the direction of the arrow b. The chains 4 are, therefore, moved to raise the panels 5 into the box 2 one after another. In the box 2, the chains 4 are first moved in the direction of the arrow b about the first sprockets 3 between the vertical guide surfaces 14*a* of the lower guide plates 14 and the arcuate guide surfaces 13*a* of the upper guide plates 13 and are, then, moved horizontally between the horizontal guide surfaces 13*b* and 14*b* of the upper and lower guide plates 13 and 14, respectively, over the fixed distance a in the direction of an arrow d toward the panel storage space, while maintaining their stretched form between the first and second sprockets 3 and 10. The panels 5 are moved by the chains 4. Therefore, each panel 5 is raised to the first sprockets 3 and is, then, moved horizontally in the direction of the arrow d over the fixed distance a from the first sprockets 3 to the second sprockets 10.

The chains 4 which have been moved horizontally to the second sprockets 10 are smoothly separated from the second sprockets 10 by the horizontal guide surfaces 14*b* of the lower guide plates 14. At the same time, the guide rollers 6 associated with one of the panels 5 which has reached the second sprockets 10 ride on the supporting rails 7. Immediately after its movement past the second sprockets 10, the panel 5 stops in a suspended position from the supporting rails 7 at a point spaced apart from the first sprockets 3 by a distance in excess of the fixed distance a. Even if another panel 5 may swing when moving in the direction of the arrow b about the first sprockets 3, therefore, it does not strike against the panel 5 staying already at a standstill.

The panels 5 reach the supporting rails 7 one after another and push the preceding panels 5 along the rails 7. Therefore, it is possible to move the panels 5 one after another along the horizontal supporting rails 7 and suspend all the panels 5 in folded shape from the supporting rails 7 in a mutually parallel and horizontally adjoining relation.

The panels 5 can be delivered from the box 2 to cover the shutter opening between the guide rails 1 again if the panel driving mechanism M is actuated for rotation in the opposite direction.

Figure 9:
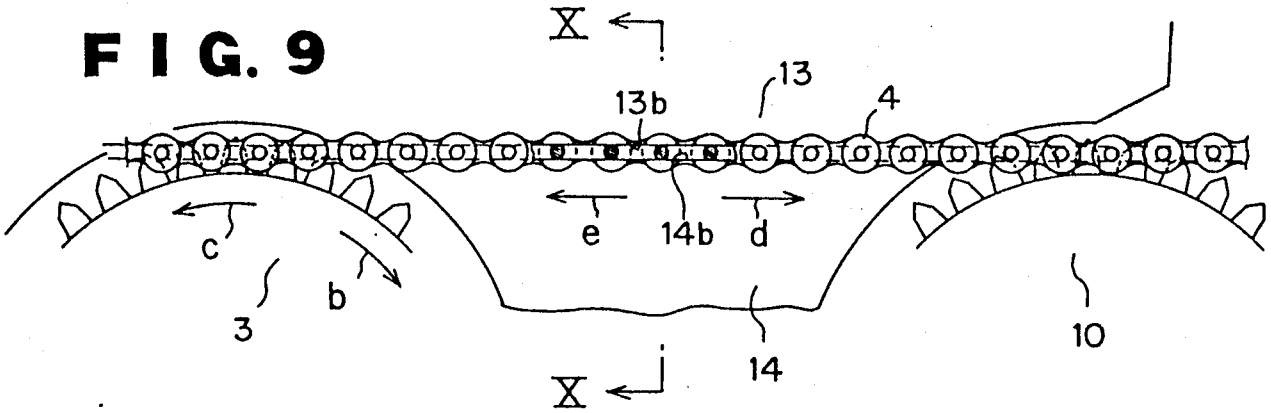
FIG. 9 is a cutaway and enlarged view showing only an important feature of another panel shutter assembly embodying this invention.
Figure 10:
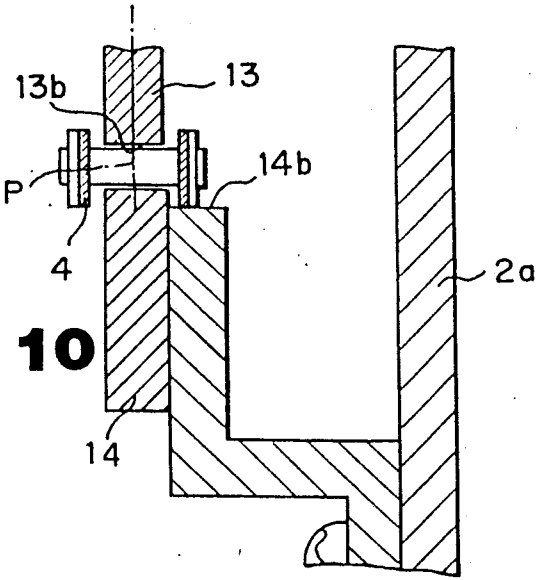
FIG. 10 is an enlarged view taken along the line X—X of FIG. 9.
Figure 12:
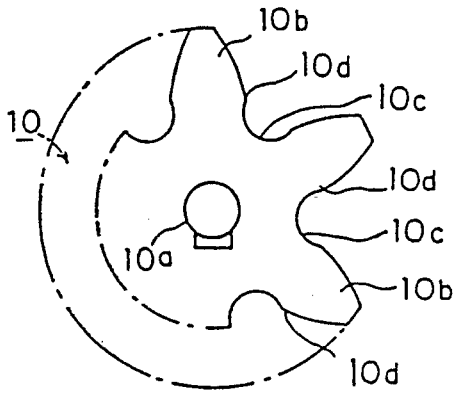
FIG. 12 is an enlarged view of the driven sprocket shown in FIG. 11.

Reference is now made to FIGS. 9 and 10 showing another embodiment of this invention. This is a modified form of the panel shutter assembly which has been described with reference to FIGS. 1 to 8. According to the modified assembly, the horizontal guide surface 14*b* of each lower guide plate 14 is located directly below the horizontal guide surface 13*b* of the corresponding upper guide plate 13, so that the horizontal guide surfaces 13*b* and 14*b* may hold the chain 4 exactly along its centerline P. This arrangement ensures the highly smooth horizontal movement of the chain 4 in the direction of the arrow d or e between the first and second sprockets 3 and 10 with the rotation of the first sprokcet 3 in the direction of the arrow b or c and thereby the highly smooth horizontal movement of the panels 5 in the same direction. The modified arrangement is equally effective, even if the second sprockets 10 may be omitted.

The intermediate sprockets 11*c* and 11*d* (FIG. 3) are employed for facilitating the erection of the panel shutter assembly at the site of installation in the event that there is no sufficient space for the erection work outside the sidewall 2*a* of the box 2. Therefore, it is possible to omit the intermediate sprockets 11*c* and 11*d* if it is possible to connect the intermediate sprockets 11*b* and 11*e* directly by a belt, or the like.

Attention is now directed to FIGS. 11 to 14 showing still another embodiment of this invention. This is another modified form of the panel shutter assembly shown in FIGS. 1 to 8. The modified assembly is characterized by the special shape of the second sprockets 10. Each second sprocket 10, which is a driven sprocket, is formed between the roots of every two adjoining teeth 10*b* thereof with a semicircular recess 10*c* in which the link pins (bushes) 4*b* of the chain 4 are engageable. Each tooth 10*b* has a projection 10*d* formed at the junction between each involute defining the tooth 10*b* and the arc defining the corresponding recess 10*c*. The projections 10*d* serve to urge down the bushes 4*b* of the chain 4 which would otherwise be likely to continue its horizontal movement away from the second sprocket 10. Each second sprocket 10 is only rotatably supported on a shaft 10*a* secured to the sidewall 2*a* of the box 2.

Figure 13:
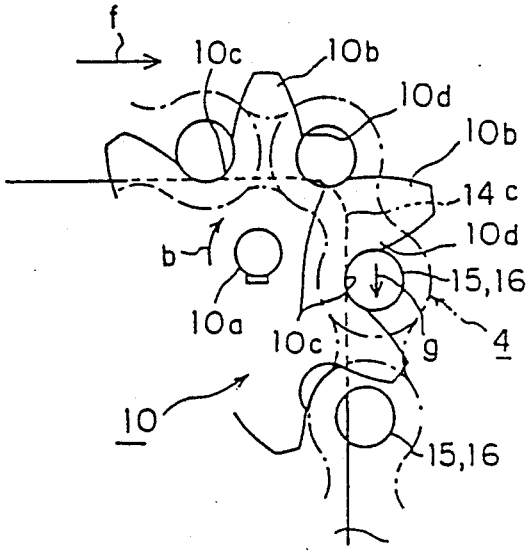
FIG. 13 is a view for explaining the operation of the sprocket shown in FIG. 12.
Figure 14:
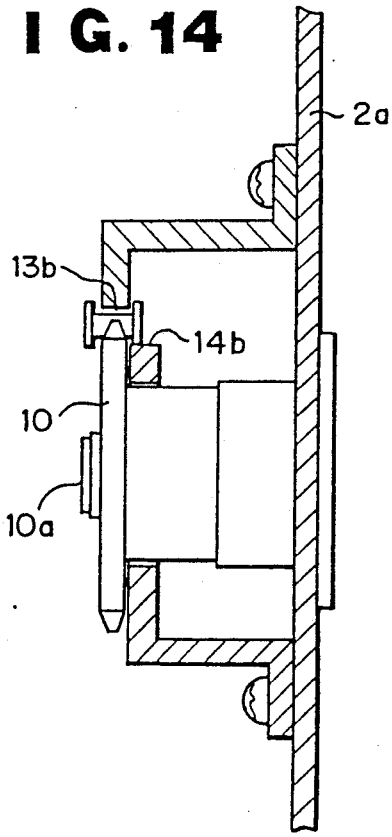
FIG. 14 is an enlarged cross-sectional view of the guide plates shown in FIG. 11.
Figure 15:
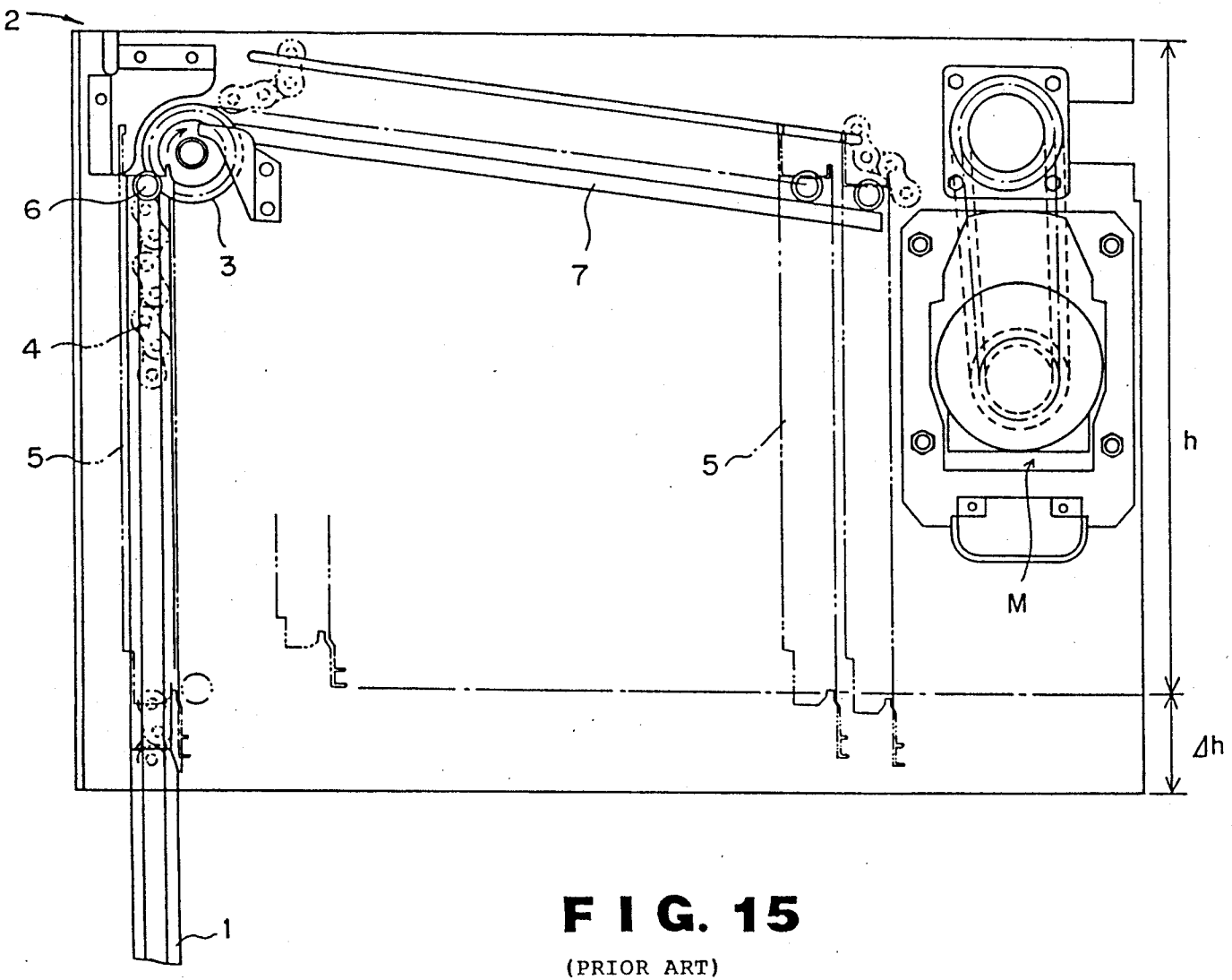
FIG. 15 (PRIOR ART)
FIG. 15 is a vertical sectional view outlining the panel storage box in a known panel shutter assembly.
Figure 16:
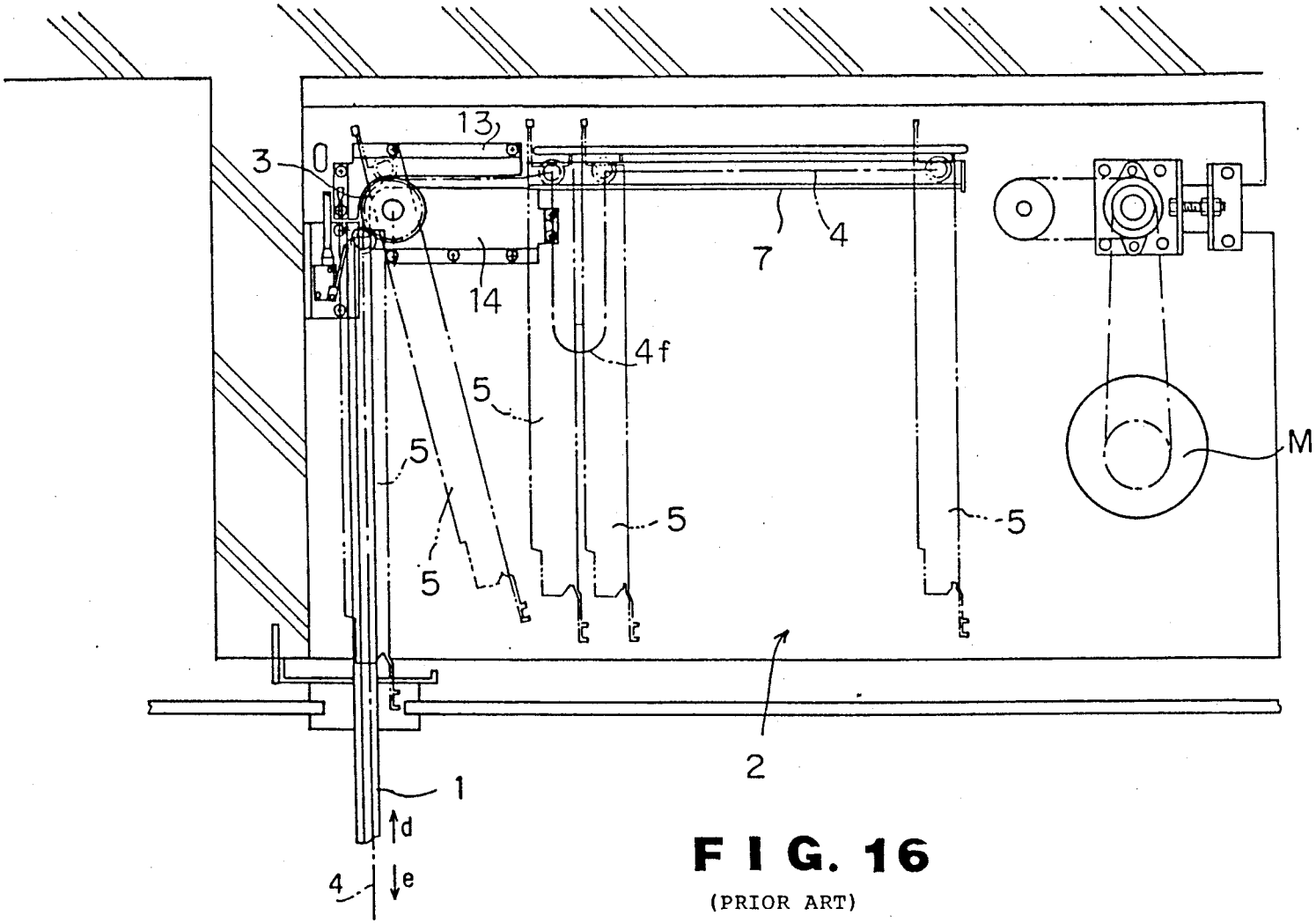
FIG. 16 (PRIOR ART)
FIG. 16 is a view similar to FIG. 15, but showing another known panel shutter assembly.

Each lower guide plate 14 has an arcuate guide surface 14*c* which is contiguous to the rear end of its horizontal guide surface 14*b*, as shown in FIG. 13. The slanting surface 13*c* of the corresponding upper guide plate 13 is located above the arcuate guide surface 14*c*, and the corresponding supporting rail 7 extends horizontally from its vicinity, though neither the upper guide plate 13 nor the supporting rail 7 is shown in FIG. 13.

Figure 11:
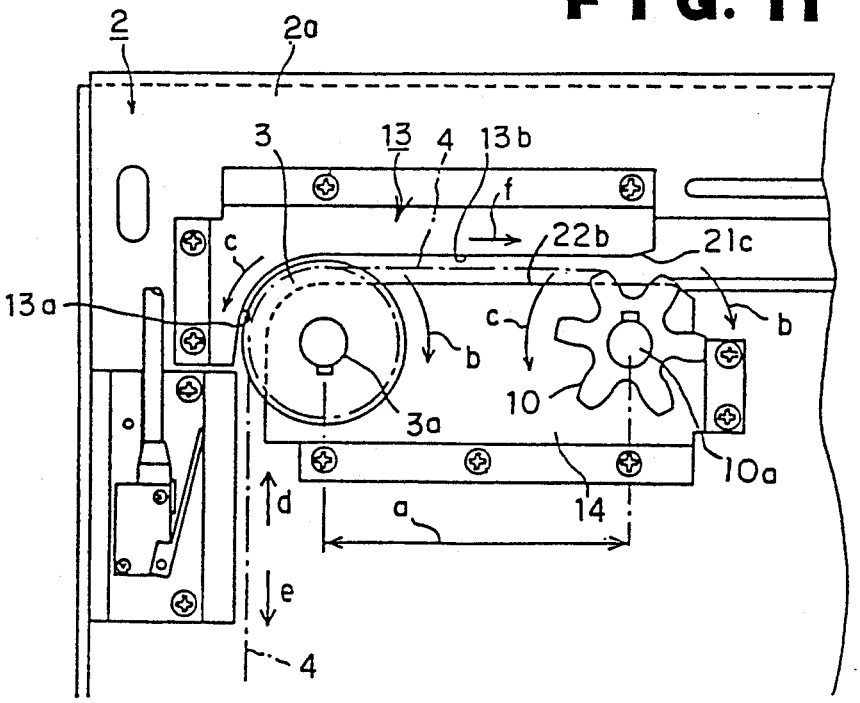
FIG. 11 is a cutaway side elevational view of still another panel shutter assembly embodying this invention.

The chains 4 moving in the direction of an arrow f are engaged by the second sprockets 10 rotating in the direction of the arrow b and are turned by an angle of about 90° for downward movement about the arcuate guide surfaces 14*c* of the lower guide plates 14, as shown in FIG. 11 or 13. The chains 4 are forced down, as the bushes 4*b* thereof are urged down in the direction of an arrow g by the projections 10*d* on the flanks of the teeth 10*b* of the sprockets 10, as shown in FIG. 13. The chains 4 are disengaged from the sprockets 10 upon abutting on the sidewalls of the lower guide plates 14, and while the rollers 6 ride on the supporting rails 7 to have the panels 5 suspended therefrom one after another, the chains 4 sag as shown at 4*f* in FIG. 16 between every two adjoining panels 5. Thus, all the panels 5 can be withdrawn effectively in the panel storage space of the box 2.

When it is necessary to close the shutter opening again, the panel driving mechanism (or more specifically, a motor) M is driven for rotation in the opposite direction to rotate the sprockets 3 and 10 in the direction of the arrow c to move the chains 4 in the direction opposite the arrow f. The rollers 7 are, therefore, moved along the supporting rails 7 with the chains 4 to deliver the panels 5 one after another along the upper and lower guide plates 13 and 14, so that the panels 5 may be moved down one after another in the direction of an arrow e in FIG. 11 until they close the entrance or exit opening.

What is claimed is:

1. In a panel shutter assembly comprising a plurality of shutter panels, a pair of transversely spaced apart upstanding guide rails defining a shutter opening therebetween, a panel storage box defining a panel storage space therein, the guide rails extending outwardly and downwardly of the box, a pair of chains to which the panels are fastened one after another, a set of sprockets provided in the box and engaging the chains, and a pair of panel supporting rails provided in the panel storage space for suspending the panels in a parallel and mutually adjoining relation to one another, the improvement wherein said sprockets consist of a pair of first sprockets provided above said guide rails for moving said panels vertically, and a pair of second sprockets horizontally spaced apart from said first sprockets and provided between said first sprockets and said space for moving said panels horizontally, each of said chains engaging one of said first sprockets and one of said second sprockets, and said panel supporting rails extend horizontally from the vicinity of said second sprockets, respectively.

2. A panel shutter assembly as set forth in claim 1, further including a guide plate provided in said box ahead of said panel supporting rails for holding each of said chains down to ensure its horizontal movement between one of said first sprockets and one of said second sprockets.

3. A panel shutter assembly as set forth in claim 1, further including a pair of guide plates provided one above the other in said box ahead of said panel supporting rails for holding each of said chains therebetween to ensure its horizontal movement between one of said first sprockets and one of said second sprockets.

4. A panel shutter assembly as set forth in claim 2 or 3, wherein said guide plate or each of said guide plates has an arcuate guide surface extending along said one of said first sprockets.

5. A panel shutter assembly as set forth in any one of claims 1 to 3, wherein each of said second sprockets has between the roots of every two adjoining teeth thereof a semicircular recess in which the link pins of one of said chains are engageable.

* * * * *

UNITED STATES PATENT AND TRADEMARK OFFICE

CERTIFICATE OF CORRECTION

PATENT NO. : 5,072,766

DATED : December 17, 1991

INVENTOR(S) : Kohichi Kondoh et al.

It is certified that error appears in the above-identified patent and that said Letters Patent is hereby corrected as shown below:

Cover page, next to last line of abstract, "to" should be --be--.

Column 5, line 30, after "4b" insert --from the panel 5. A guide roller 6 is rotatably supported--.

Signed and Sealed this

Twenty-seventh Day of April, 1993

*Attest:*

MICHAEL K. KIRK

*Attesting Officer*

*Acting Commissioner of Patents and Trademarks*